US005730887A

United States Patent [19]

Simpson et al.

[11] Patent Number: 5,730,887

[45] Date of Patent: Mar. 24, 1998

[54] DISPLAY APPARATUS HAVING ENHANCED RESOLUTION SHADOW MASK AND METHOD OF MAKING SAME

[75] Inventors: Theodore Frederick Simpson; Istvan Gorog; Bruce George Marks, all of Lancaster; Charles Michael Wetzel, Lititz; Craig Clay Eshleman, Pequea, all of Pa.

[73] Assignee: Thomson Consumer Electronics, Inc., Indianapolis, Ind.

[21] Appl. No.: 627,236

[22] Filed: Apr. 1, 1996

Related U.S. Application Data

[62] Division of Ser. No. 321,131, Oct. 14, 1994, abandoned.

[51] Int. Cl.[6] ..... B44C 1/22; H01J 29/06

[52] U.S. Cl. ..... 216/12; 216/41; 216/56; 313/403; 430/5

[58] Field of Search ..... 216/12, 24, 56

[56] References Cited

U.S. PATENT DOCUMENTS

| | | | |
|---|---|---|---|
| 3,519,869 | 7/1970 | Kuniyoshi | 313/85 |
| 3,705,322 | 12/1972 | Naruse et al. | 313/85 S |
| 3,973,965 | 8/1976 | Suzuki et al. | 96/36.1 |
| 4,168,450 | 9/1979 | Yamauchi et al. | 313/403 |
| 4,429,028 | 1/1984 | Kuzminski | 430/5 |
| 4,518,892 | 5/1985 | Thoms | 313/403 |
| 4,528,246 | 7/1985 | Higashinakagawa | 313/402 |
| 4,588,676 | 5/1986 | Moscony et al. | 430/327 |
| 4,632,726 | 12/1986 | Thoms | 156/644 |
| 4,662,984 | 5/1987 | Ohtake et al. | 156/637 |
| 4,689,114 | 8/1987 | Ohtake et al. | 156/644 |
| 4,743,795 | 5/1988 | Thoms | 313/402 |
| 5,484,074 | 1/1996 | Deibler et al. | 216/5 |
| 5,526,950 | 6/1996 | Tago et al. | 216/12 |

FOREIGN PATENT DOCUMENTS

| | | | |
|---|---|---|---|
| 2166107 | 8/1973 | France | H01J 31/00 |
| 2266296 | 10/1975 | France | H01J 29/07 |
| 57-057449 | 4/1982 | Japan | H01J 29/07 |
| 4-10335 | 1/1992 | Japan | H01J 29/07 |
| 2020892 | 11/1979 | United Kingdom | H01J 29/07 |

OTHER PUBLICATIONS

European Search Report.

Search Report & Opinion, Shingapore.

*Primary Examiner*—R. Bruce Breneman

*Assistant Examiner*—Michael E. Adjodha

*Attorney, Agent, or Firm*—Joseph S. Tripoli; Dennis H. Irlbeck; Vincent J. Coughlin, Jr.

[57] ABSTRACT

In accordance with the present invention, a display apparatus 8 comprises a color CRT 10 having an evacuated envelope 11 with a faceplate panel 12 sealed to one end of a funnel 15 that is closed at the other end by a neck 14. The faceplate panel has a luminescent screen 22 on an interior surface thereof. A shadow mask 25 is located in proximity to the screen. The shadow mask comprises a metal sheet having a central portion and an exterior portion with a plurality of apertures 40, 43 therethrough. An electron gun 26 is disposed within the neck for generating and directing electron beams 28 toward the screen. A deflection yoke 30 is disposed around the envelope at the junction of the neck and the funnel. The yoke deflects the beams to scan a raster across the screen. The display apparatus is improved other prior devices in that the apertures 43 in the exterior portion of the mask, on the screen-facing side thereof, have openings 45 that are elongated in the direction of the incident electron beams and offset relative to the corresponding openings 44 on the electron gun-facing side of the mask. A method of making the present mask also is disclosed.

5 Claims, 6 Drawing Sheets

Fig. 2
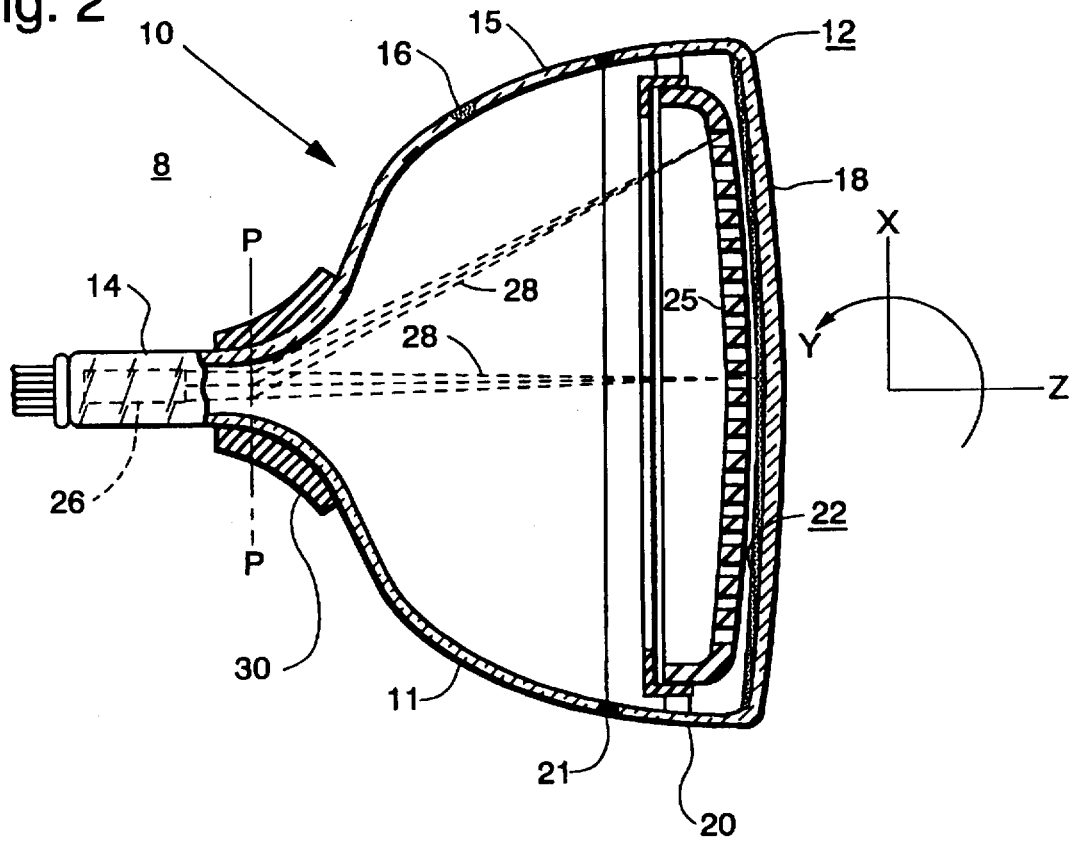
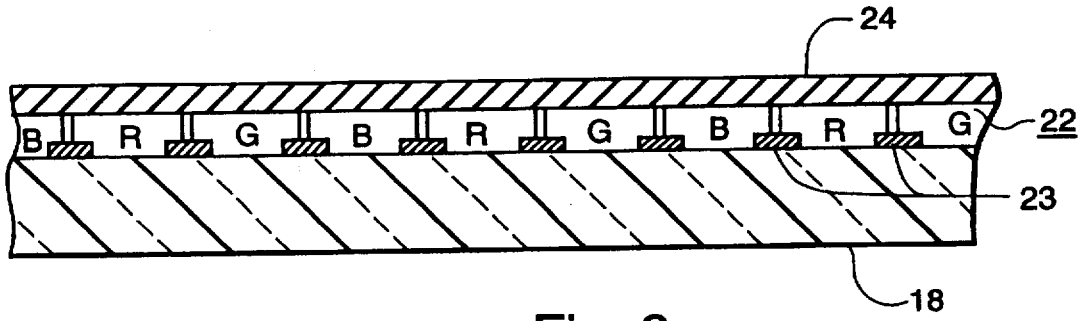
Fig. 3

DISPLAY APPARATUS HAVING ENHANCED RESOLUTION SHADOW MASK AND METHOD OF MAKING SAME

This is a division of application Ser No. 08/321,131, filed Oct. 14, 1994, now abandoned.

The present invention relates to a display apparatus comprising a color cathode-ray tube with a deflection yoke and more particularly, to a color cathode-ray tube having an enhanced resolution shadow mask, and to a method of making such a mask.

BACKGROUND OF THE INVENTION

In a color display apparatus, a cathode-ray tube includes a luminescent screen formed on an interior surface of an evacuated tube envelope. The screen may be either a dot screen or a line screen, as is known in the art. An electron gun is disposed within the envelope and emits electron beams toward the screen. A shadow mask is located in proximity to the screen and provides a color selection function; i.e., each of the apertures formed in the mask corresponds to one triad of color admitting phosphor elements to cause the incident electron beams to strike precisely one of the predetermined color-emitting phosphor elements to reproduce a color image. In such a display tube, the quality of the image is determined by, among other things; the pitch or spacing of the apertures in the shadow mask. Enhanced resolution shadow masks are defined as masks which provide medium or high resolution images. One drawback of such enhanced resolution shadow masks is that, as the aperture array increases in density, i.e., the number of holes increases, the structural integrity of the mask decreases, resulting in masks that are inherently weak and prone to damage during normal handling in the tube manufacturing process.

FIG. 1 shows a conventional display tube shadow mask 2 having a plurality of apertures 3 formed therethrough. The apertures 3 have circular openings 4 on the grade side of the mask, facing the electron gun (not shown), and corresponding circular openings 5 on the cone or screen-facing side of the mask. To prevent the incident electron beams from striking the peripheral portion of the mask surrounding the apertures 3, the diameter of the openings 5 on the cone-side of the mask is significantly larger than the diameter of the openings 4 on the grade-side, and the cone-side openings 5 are offset in the direction of the incident electron beams, to provide the required clearance for the beams exiting the mask apertures.

U.S. Pat. No. 3,705,322, issued on Dec. 5, 1972 to Naruse et al., discloses a shadow mask having apertures that are circular in the central portion of the mask, and gradually become elliptical as the peripheral portion of the mask is approached. The shape of the aperture openings is the same on the grade side and the cone side of the mask; i.e., at the peripheral portions of the mask, the aperture openings are elliptical on both sides of the mask. The electron gun, is an in-line gun and the screen is outwardly curved. The elliptical apertures are said to maintain color purity and provide a correction for a twist in the landing position of the electron beams caused by the in-line alignment of the gun and the curvature of the screen. The elliptical apertures have their long axes aligned with one of the barrel-shaped curved lines which pass through the rows of apertures. As shown in FIG. 10 of the patent, the phosphor dots are elliptical in shape in order to maintain color purity. Also, as shown in FIG. 12, thereof the elliptical apertures are formed on a concentric circle about the center of the mask. At all locations, except along the major axes, the long axis of the elliptical apertures are transverse to the beam angle of the incident electron beams. Thus, the apertures must be relatively large to permit passage of the beams without stalking the peripheral portions of the mask surrounding the apertures. A drawback of such a mask structure is that a considerable amount of material must be removed from the mask to form apertures large enough to provide clearance for the electron beams, thereby weakening the mask. A need therefore exists for a shadow mask capable of medium and high resolution performance, but with greater inherent strength than the current masks.

SUMMARY OF THE INVENTION

In accordance with the present invention, a display apparatus comprises a color CRT having an evacuated envelope with a faceplate panel sealed to one end of a funnel that is closed at the other end by a neck. The faceplate panel has a luminescent screen on an interior surface thereof. A shadow mask is located in proximity to the screen. The shadow mask comprises a metal sheet having a central portion and an exterior portion with a plurality of apertures therethrough. An electron gun is disposed within the neck for generating and directing electron beams toward the screen. A deflection yoke is disposed around the envelope at the junction of the neck and the funnel. The yoke deflects the beams to scan a raster across the screen. The display apparatus is improved prior devices in that the apertures in the exterior portion of the mask, on the screen-facing side thereof, have openings that are elongated in the direction of the incident electron beams and offset relative to the corresponding openings on the electron gun-facing side of the mask. A method of photoetching the present mask also is disclosed.

BRIEF DESCRIPTION OF THE DRAWINGS

The invention will now be described in greater detail, with relation to the accompanying drawings in which:

FIG. 2 is a plan view, partially in axial section, of a color display apparatus embodying the present invention;

FIG. 3 is a section of a screen of the tube shown in FIG. 2;

DETAILED DESCRIPTION OF THE PREFERRED EMBODIMENTS

Figure 1:
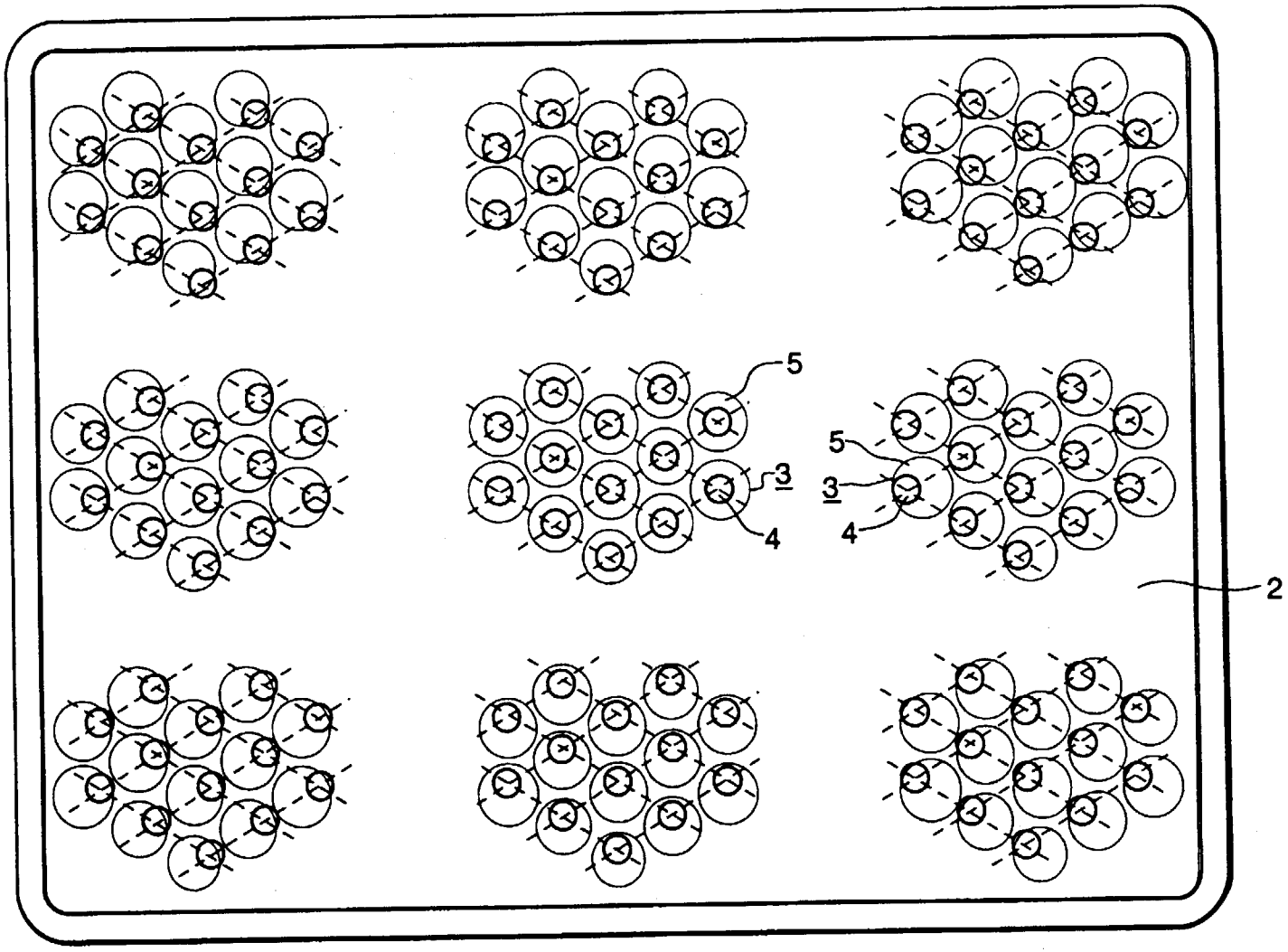
Fig. 1 (PRIOR ART)
FIG. 1 is a plan view of a conventional dot array shadow mask

FIG. 2 shows a color display apparatus 8 comprising a color CRT 10 having a glass envelope 11 with a rectangular faceplate panel 12 and a tubular neck 14 connected by a rectangular funnel 15. The funnel 15 has an internal conductive coating (not shown) that contacts an anode button 16 and extends into the neck 14. A conductive coating (also not shown) overlies the external surface of the funnel 15 and is connected to ground, as is known in the art. The panel 12 comprises a viewing faceplate or substrate 18 and a peripheral flange or sidewall 20, which is sealed to the funnel 15 by a glass frit 21. A three color phosphor screen 22 is carried on the inner surface of the faceplate 18. The screen 22, shown in FIG. 3, may be a dot screen or a line screen which includes a multiplicity of screen elements comprised of red-emitting, green-emitting and blue-emitting phosphor elements R, G, and B, respectively, arranged in color groups or picture elements of three dots or stripes, in a cyclic order. Preferably, at least portions of the phosphor elements overlap a relatively thin, light absorptive matrix 23, as is known in the art. A thin conductive layer 24, preferably of aluminum, overlies the screen 22 and provides means for applying a uniform potential to the screen, as well as for reflecting light, emitted from the phosphor elements, through the faceplate 18. A multi-apertured color selection electrode or shadow mask 25 is removably mounted, by conventional means, in predetermined spaced relation to the screen 22.

An electron gun 26, shown schematically by the dashed lines in FIG. 2, is centrally mounted within the neck 14, to generate and direct three electron beams 28 along convergent paths, through the apertures in the mask 25, to the screen 22. The electron gun 26 is a conventional in-line gun; however, any suitable gun known in the art may be used.

The tube 10 is designed to be used with an external magnetic deflection yoke, such as yoke 30, located in the region of the funnel-to-neck junction. The combination of the tube 10 and the yoke 30 comprises the display apparatus 8. When activated, the yoke 30 subjects the three beams 28 to magnetic fields which cause the beams to scan horizontally and vertically, in a rectangular raster, over the screen 22. The initial plane of deflection (at zero deflection) is shown by the line P—P in FIG. 2, at about the middle of the yoke 30. For simplicity, the actual curvatures of the deflection beam paths, in the deflection zone, are not shown.

Figure 4:
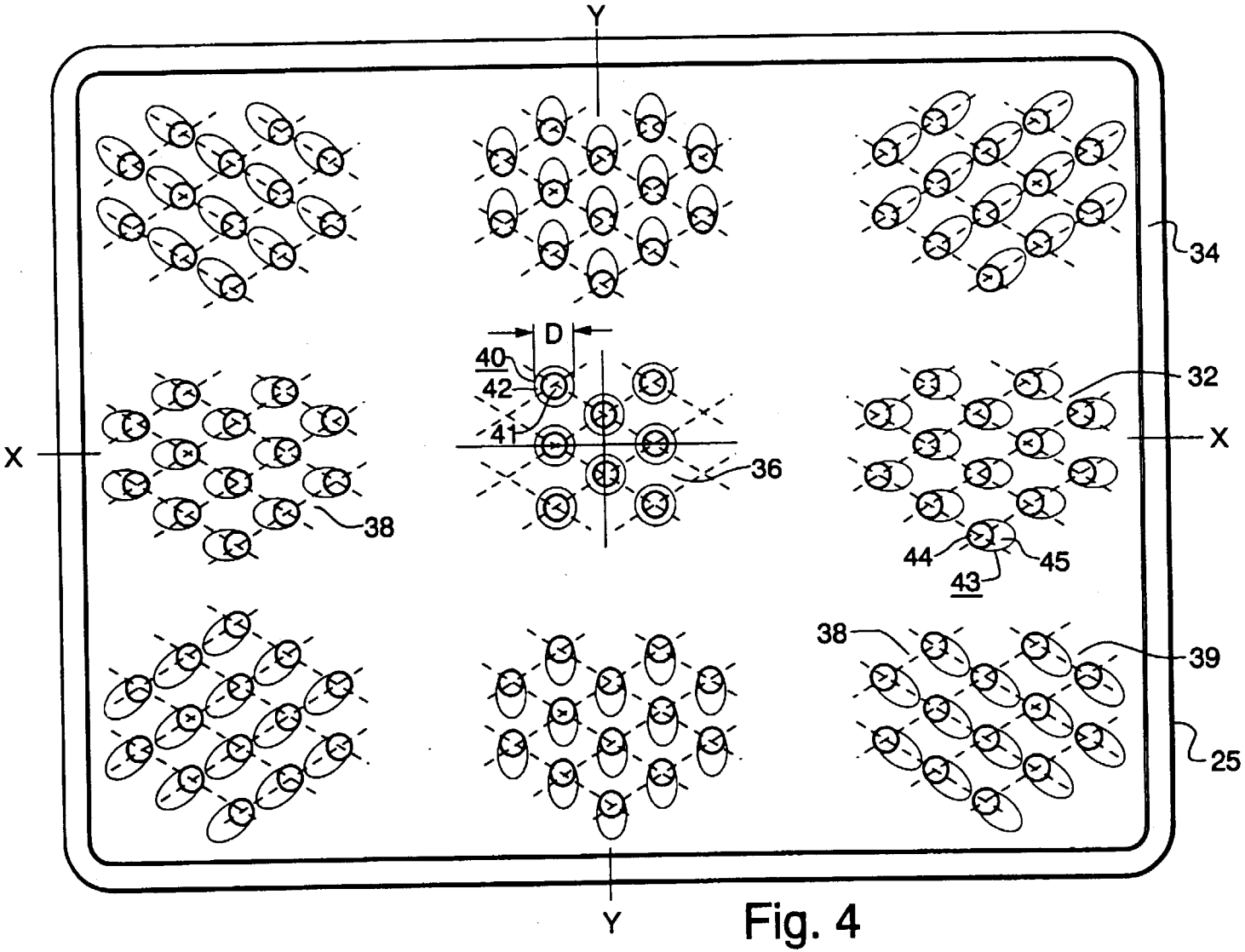
FIG. 4 is a plan view of a novel shadow mask of the present invention.

The shadow mask 25, shown in greater detail in FIG. 4, is substantially rectangular and includes an apertured portion 32 and an imperforate border portion 34 surrounding the apertured portion 32. Nine areas of the apertured portion 32 of the mask 25 are shown. These areas include a central portion 36, at the intersection of the major axis X and the minor axis Y, and eight areas of the exterior portion 38. The eight areas of the exterior portion 38 are located at the extremities of the major axis, the minor axis and the diagonals. In the central portion 36 of the mask 25, a plurality of circular apertures 40 are formed by selectively etching circular openings 41, 42 into the oppositely disposed surfaces of a metal sheet 39. The opposing surfaces of the mask are designated as the grade, or electron gun-facing, side and the cone, or screen-facing, side, respectively. In the exterior portion 38 of the mask 25, a plurality of apertures 43 are formed which have circular openings 44 on the grade side, and substantially elliptical or oval openings 45 on the cone side. Furthermore, the major axis of each substantially elliptical opening 45 is oriented in the direction of the incident electron beams 28, so that in the exterior portion 38 of the mask the openings 45 extend radially outwardly from the central portion 36. Because the corresponding aperture openings 44 on the grade side of the mask 25 are circular, when the mask is used as a photomaster to print the screen, circular dots will be produced on the interior surface of the faceplate panel. Preferably, the substantially elliptical openings 45 of the apertures 43, in the exterior portion 38 of the mask, are offset relative to the corresponding circular openings 44 to further increase the clearance for electron beams passing through the apertures.

Figure 5:
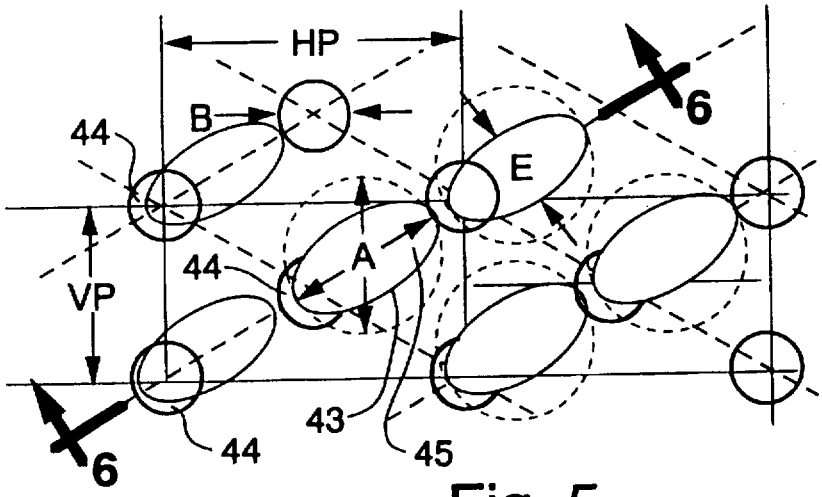
FIG. 5 is a section of the novel mask taken along the diagonal.

The advantage of the substantially elliptical openings 45 for the apertures 43, in the exterior portion 38 of the mask 25, over the conventional circular openings, is shown in FIG. 5, which is a section of the mask taken along a diagonal. Each of the apertures 43 has a substantially elliptical opening 45 on the cone side of the mask with a major axis dimension, "A", that extends along the path of the incident electron beams 28, shown in FIG. 2. If "A" were the diameter of a conventional circular opening, as shown in phantom in FIG. 5, the amount of mask material that would have to be removed to provide the circular opening is obviously greater than the amount of mask material that is removed to form the substantially elliptical opening 45. Consequently, a mask having apertures with substantially elliptical openings 45 in the cone side of the exterior portion thereof would retain more material in the mask, and would be inherently stronger, than a mask with circular aperture openings of a diameter equal to the major axis dimension of the substantially elliptical aperture openings.

Figure 6:
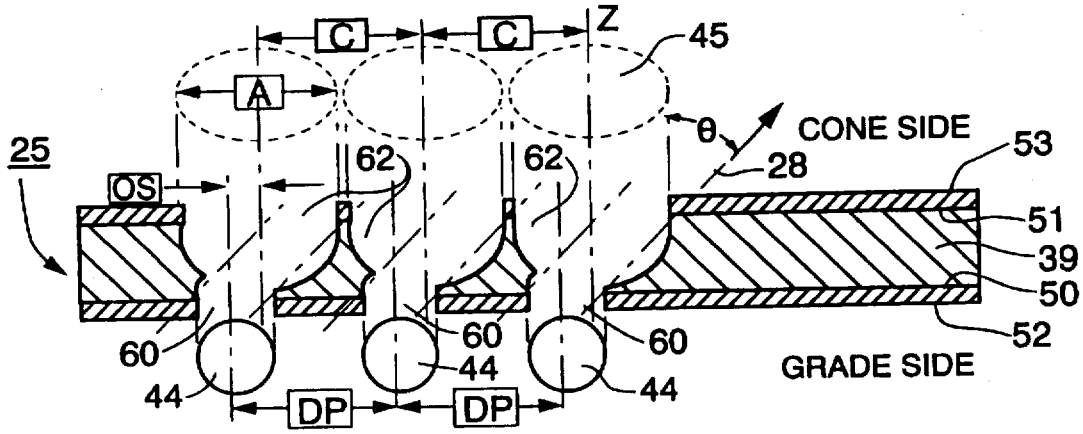
FIG. 6 is a cross sectional view of a portion of the novel mask along the diagonal, showing a preferred etch pattern.

TABLE I lists the elements, with corresponding symbols and dimensions, of a novel medium resolution shadow mask for a tube having a 66 cm. diagonal dimension, a 16×9 aspect ratio, and a deflection angle of about 106°. As shown in FIG. 5, the "horizontal pitch" (HP) and "vertical pitch" (VP) refer to the center-to-center spacing between adjacent horizontal and vertical circular aperture openings 44, respectively, on the grade side of the mask 25, and the diameter of each of the circular openings 44; in FIG. 5 is designated "B". The diameter of the circular openings 42 on the cone side of the apertures 40, in the central portion of the mask 36, is designated "D", as shown in FIG. 4. Again with reference to FIG. 5, adjacent columns and rows of apertures are staggered in such a manner that the centers of the circular aperture openings 44, on the grade side of the mask, in adjacent columns, are located an equal distance from each other, thereby forming an equilateral triangle. From FIGS. 5 and 6, it is evident that the "diagonal pitch" (DP), or the center-to-center spacing between adjacent circular openings 44, along the diagonal, on the grade side of the mask, is equal to the vertical pitch (VP); however, it is recognized that DP and VP may be different from one another. "Incident beam angle", shown in FIG. 6 as "θ", refers to the angle between the Z-axis of the tube and the path of the incident electron beams 28. For example, at the center of the mask 25, the path of the beams 28 is co-parallel to the Z-axis of the tube, so the incident beam angle is zero. As the beams are scanned in a raster across the screen, the beam angle increases, reaching a maximum at the corners of the mask. For the above-described medium resolution tube, the incident beam angle, "θ", at the corner of the mask is about 39°, and the major axis dimension, "A", of the substantially elliptical openings 45 of the mask apertures 43, is greater in the corners. The center-to-center spacing between adjacent ellipses, along the diagonal, is designated "C", and is shown in FIG. 6. The displacement between the center of the circular openings 44 on the grade side of the mask 25, and the center of the substantially elliptical openings 45 on the cone side, for the corresponding aperature 43, is designated as the "offset" and is identified in FIG. 6 as "OS". The diameter "B" of the circular openings 44 on the grade side of the mask, for the apertures 43, may be equal to the diameter of the openings 41 at the center of the mask, or the openings 44 may be different in diameter than the openings 41, and either decrease in diameter from center-to-edge, or first increase and then decrease in diameter as the distance from the center of the mask increases, as is known in the art. In the present example, the diameter "B" is held constant from the center to the edge of the mask, so that the diameters of the openings 41 and 44 are equal. The minor axis dimension, "E", of the substantially elliptical openings 45, is larger than the diameter of the grade side circular openings 44. In TABLE I, all dimensions are in micrometers, μ, unless otherwise indicated.

TABLE I

| Element | Symbol | Dimension μ |
|---|---|---|
| Grade side aperture openings 41,44 | B | 225 |
| Cone side aperture openings 42 | D | 280 |
| Cone side major axis openings 45 | A | 370 |
| Cone side minor axis openings 45 | E | 305 |
| Mask thickness | t | 170 |
| Vertical Pitch | VP | 463 |
| Horizontal Pitch | HP | 802 |
| Diagonal Pitch | DP | 463 |
| Offset | OF | 84 |
| Maximum Incident Beam Angle | θ | 39° |

TABLE II lists the elements, with corresponding symbols and dimensions, of a high resolution shadow mask for a tube having a 66 cm. diagonal dimension, a 16×9 aspect ratio, and a deflection angle of 106°. The same reference numbers and symbols used in the medium resolution mask are used to refer to corresponding elements in the high resolution mask. All dimensions are in micrometes, μ, unless otherwise indicated.

TABLE II

| Element | Symbol | Dimension μ |
|---|---|---|
| Grade side aperture openings 41,44 | B | 127 |
| Cone side aperture openings 42 | D | 140 |
| Cone side major axis openings 45 | A | 254 |
| Cone side minor axis openings 45 | E | 210 |
| Mask thickness | t | 150 |
| Vertical Pitch | VP | 270 |
| Horizontal Pitch | HP | 468 |
| Diagonal Pitch | DP | 270 |
| Offset | OF | 60 |
| Maximum Incident Beam Angle | θ | 44° |

The mask 25 is manufactured by etching the metal sheet 39 to form the apertures therethrough. As shown in FIG. 6, the metal sheet 39 has two oppositely disposed major surfaces 50 and 51, respectively. The sheet 39 is coated on both major surfaces with a known liquid coating composition which, when dry, produces a first light sensitive, photoresist layer 52 and a second light sensitive, photoresist layer 53 on the surfaces 50 and 51, respectively. The layers overlie the central portion and the exterior portion of both surfaces of the sheet 39. The composition of the coatings may be a dichromate sensitized polyvinyl alcohol, or any equivalent material.

When the layers 52 and 53 are dried, the coated sheet 39 is placed into a vacuum printing frame, or chase, between two master patterns having opaque areas, each supported on a separate glass plate. Neither the chase, the patterns, nor the plates are shown, but they are of the type described in U.S. Pat. No. 4,588,676, issued to Moscony et al. on May 13, 1986. The pattern in contact with the photoresist layer 53 on the surface 51 of the sheet 39 differs from conventional patterns, in that the opaque areas of the pattern in the exterior portion thereof are elongated in the direction of the incident electron beams, while the opaque areas in the central portion are circular. Preferably, the opaque areas in the exterior portion of the pattern are substantially elliptical, with the major axis of each ellipse lying in the direction of the incident electron beams. The pattern in contact with the photoresist layer 52 is conventional and has circular opaque areas in both the central and exterior portions thereof. The circular opaque areas of the pattern in contact with the layer 52 are smaller in diameter than the opaque circular areas and the substantially elliptical opaque areas of the pattern in contact with the coating 53 . The substantially elliptical opaque areas in the pattern are made by photoplotting a single exposure of a substantially elliptical aperture, or multiple exposures of a round aperture of suitable diameter, successively displaced or offset, to produce a substantially elliptical opaque area of the desired size.

The sheet 39 and the glass plates, having the opaque patterns thereon, are placed in the vacuum chase, and the chamber formed between the glass plates and the metal sheet is evacuated to bring the patterns into intimate contact with the layers 52 and 53. Actinic radiation from a suitable light source illuminates the portions of the layers 52 and 53 that are not shadowed by the opaque areas. When the layers 52 and 53 have been suitable exposed, the exposure is stopped, the printing frame is devacuated and the coated sheet 39 is removed.

The exposed layers 52 and 53 are now developed as by flushing with water or other aqueous solvent to remove the unexposed, more soluble shadowed areas of the layers. As shown in FIG. 6, after development, the sheet 39 carries on its major surfaces patterns of openings corresponding to the opaque areas on the glass plates. The openings 60 formed in the first pattern in layer 52, on the grade side of the sheet 39, are circular in both the central and exterior portions of the sheet. The openings 62, formed in the second pattern in layer 53, on the cone side of the exterior portion of the sheet 39, are substantially elliptical and are offset relative to the circular openings 60 formed in the first pattern. The circular openings formed in the central portion of the second pattern in layer 53 are not shown in FIG. 6, but are coaxially aligned with, and larger than, the openings 60 formed in the central portion of the first pattern. The layers 52 and 53 with the pattern of openings formed therein are now baked in air at about 250° C. to 275° C. to provide etch resistance patterns. The sheet 39 with the etch resistant patterns thereon is now selectively etched from both sides thereof, preferably in a single step, to produce apertures having openings corresponding to the openings in the first and second photoresist patterns.

While one method of providing the substantially elliptical opaque pattern on the glass plate is by multiple exposures of a round aperture, it is also possible to achieve the same effect by exposing circular images, successively displaced outwardly in the direction of the incident electron beams, in the exterior portion of the pattern, on multiple plates, and then multi-printing the different plates onto one composite plate. This procedure is more time consuming than the above described method and is not preferred.

Figure 7:
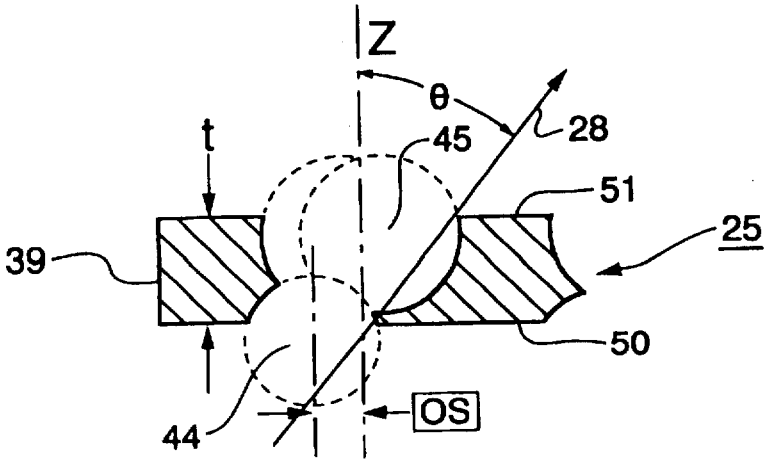
FIG. 7 is a cross sectional view of a portion of the novel mask along the diagonal, showing a second embodiment of an etch pattern for the novel mask.

FIG. 7 shows a multiple etch method of making substantially elliptical aperture openings on one side of the metal sheet 39. The structure of FIG. 7 shows the sheet 39 after the etching has been completed. Initially, both surfaces 50 and 51 of the sheet 39 are coated to provide photoresist layers (not shown) thereon. Then, glass plates with circular opaque areas are positioned in contact with photoresistive layers on surfaces 50 and 51, evacuated and exposed to actinic radiation to selectively change the solubility of the photoresist layers. The photoresist layers are developed with water to remove the more soluble areas shadowed by the opaque areas of the pattern on the glass plates, to form an intermediate pattern of openings in the photoresist layers. The photoresist patterns are heated to make them etch resistant, and then the metal sheet 39 is selectively etched through the openings in the photoresist layers to at least partially form openings in both surfaces thereof. The etching is stopped, and the sheet is stripped to remove the hardened photoresist layers. Next, the sheet is recoated with the photoresist material to form new layers on both sides thereof. The photoresist material overlies the previous etched openings as well as the unetched portion of the sheet 39. A glass plate with either an opaque pattern of circles thereon, or a clear glass plate, is placed in contact with the photoresist layer on the grade side 50 of the sheet. If a clear glass plate is used, then the entire resist layer on the grade side of the sheet 39 will be rendered insoluble by the actinic radiation, and no further etching of the grade side of the sheet will occur. However, a second glass plate having a pattern of circular opaque areas, which are offset outwardly in the direction of the incident electron beams, in the exterior portion of glass plate, is placed in contact with the photoresist layer on the cone side 51 of the metal sheet, in order to make a second exposure. The circular areas in the central portion of the second glass plate are unchanged from those of the first exposure, so that the openings formed in the central portion of the sheet are aligned on both sides. The photoresist layers are exposed to actinic radiation, developed to form patterns, and the sheet is etched again. After the second etch, the openings 45 on the cone side of the sheet 39 are substantially elliptically elongated, while the openings 44 on the grade side are circular. By protecting the previously etched openings with another layer of the photoresist material that has been exposed and heated to render it etch resistant, the openings may be extended deeper into the mask without unnecessarily removing metal near the surface that does not affect electron beam transmission, but does provide strength to the mask. While the multiple etch process is described using only two etch steps, it should be understood that additional coating, photoexposing, developing and etch steps are within the scope of this invention.

Figure 8:
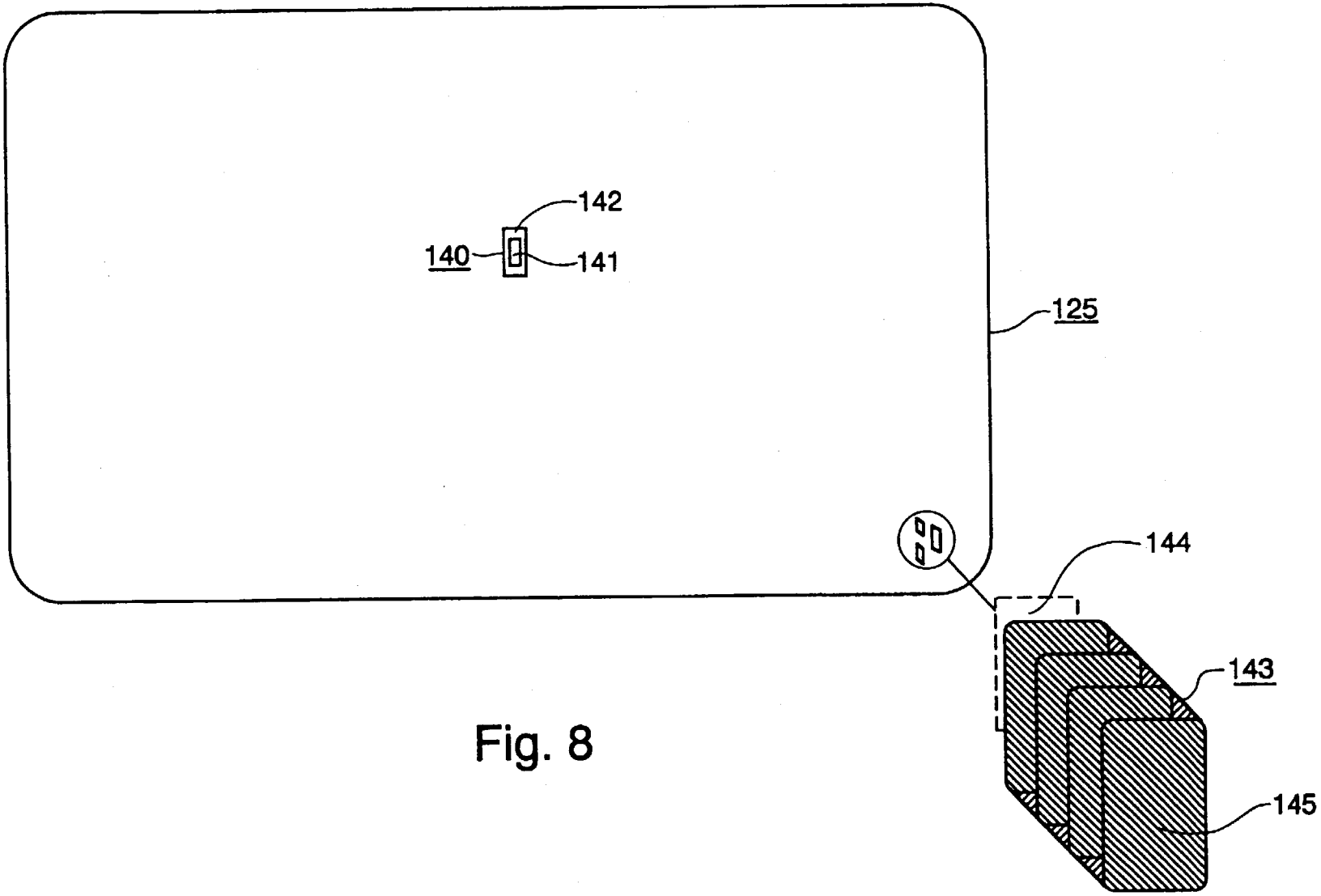
FIG. 8 is a segment of a shadow mask showing another embodiment of the present invention.

The same techniques described above, with respect to forming substantially elliptical openings in the exterior portion of one surface of the mask and corresponding circular openings on the other surface of the mask, may be employed to form polygonal openings in the exterior portion of the mask and rectangular openings on the opposite side thereof. The resultant mask may be used to make a line screen for a display tube. An opaque polygon-shaped exposure pattern may be formed in the exterior portion of a glass plate, or the multiple photoexposure technique described above may be used. In the latter method, rectangular opaque areas may be formed in a central portion of a glass plate and polygonal opaque areas may be formed in the exterior portion thereof. The polygonal areas are formed by repeated exposure of a rectangular pattern that is successively offset in the direction of the incident electron beams. The glass plate is used to expose a photoresist layer that provides a pattern of openings in the layer. FIG. 8, shows an exterior portion of the mask 125, along a diagonal thereof, having an aperture 143 on the cone side with a polygonal opening 145 made using the photoresist layer having the pattern of rectangular and polygonal openings described herein. In the central portion of the mask 125, apertures 140 have rectangular openings 142 on the cone side, and openings 141 on the grade side. Alternatively, the polygonal and rectangular openings may be formed by the process of multi-step etching.

Figure 9:
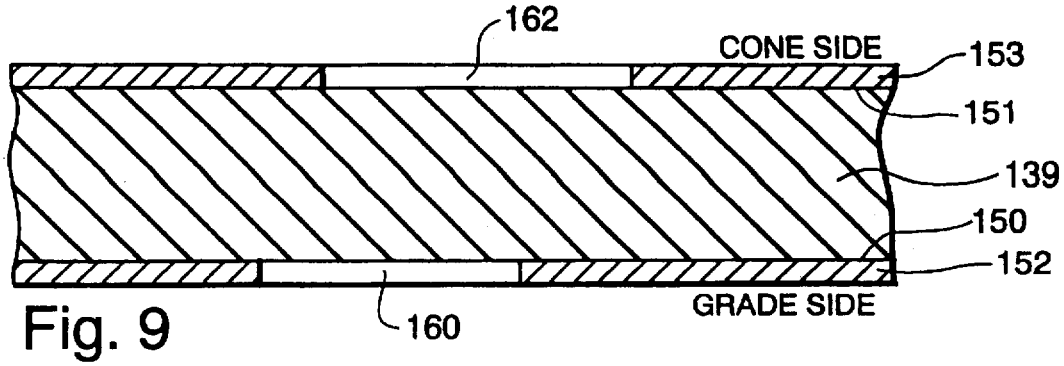
FIG. 9 is a segment of a mask sheet showing patterns of openings in photoresist layers in an exterior portion of the sheet.
Figure 10:
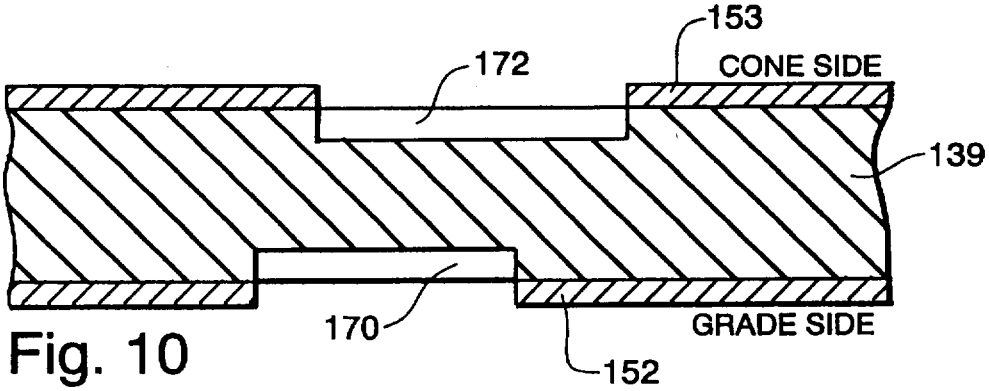
FIG. 10 shows the sheet of FIG. 9 after a partial etch thereof.
Figure 11:
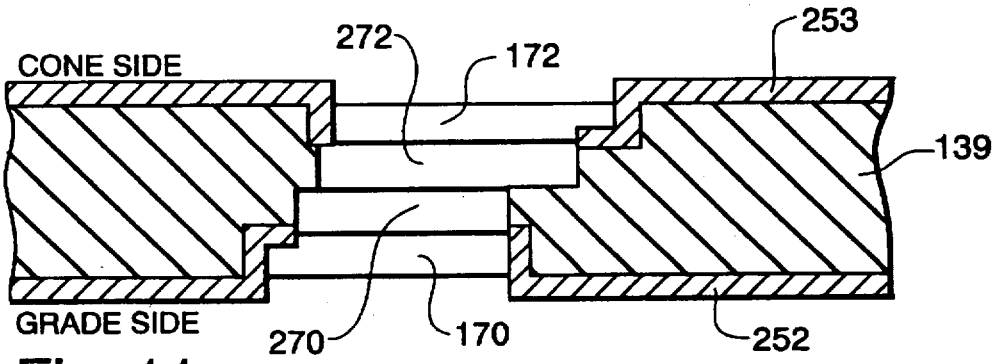
FIG. 11 shows the sheet of FIG. 10 after a second etch.
Figure 12:
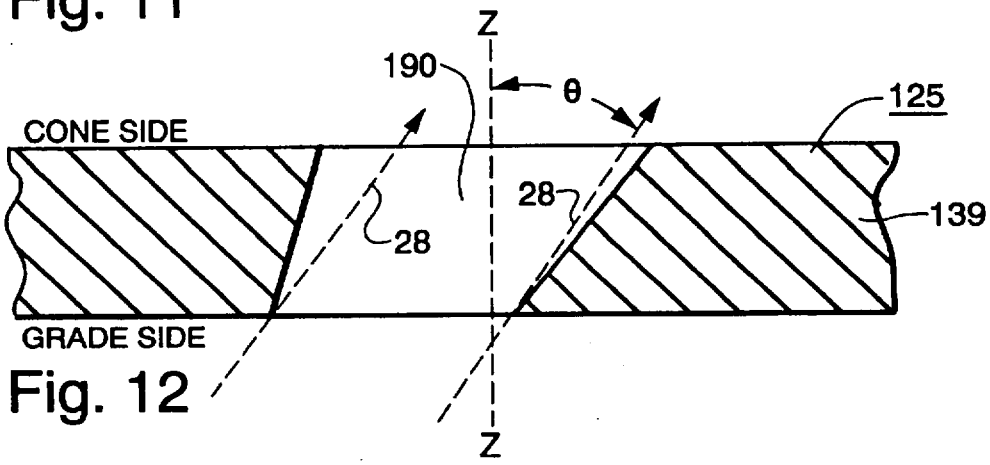
FIG. 12 shows the sheet with the resulting aperture, after the photoresist is removed.

The following method of multi-step etching may be utilized to form elongated apertures in the exterior portion on the cone side of the mask. With reference to FIGS. 9–12, a sheet 139 has first photoresist layers 152 and 153 disposed on its grade side and cone side surfaces 150 and 151, respectively. Suitable master patterns having opaque areas are provided on a first set of glass plates which contact the coated sheet 139. The plates and the sheet are placed into a chase and exposed to actinic radiation to selectively alter the solubility of the photoresist layers. Neither the glass plates, the opaque patterns, nor the chase is shown. Then, the layers 152 and 153 are developed to remove the more soluble, shadowed areas of the photoresist, to form first openings 160 and 162, which are shown in FIG. 9. The first openings 160 may, for example, be rectangular or circular, and the first openings 162 may, for example, be rectangular or substantially elliptical. Preferably, as shown in FIG. 9, the first openings 162 in the resist layer 153 are larger than, and offset outwardly from, the openings 160 in the resist layer 152. Then, the sheet 139 is etched from both sides, as shown in FIG. 10, to provide openings 170 and 172 into the grade side and the cone side, respectively, of the sheet. The first openings 170 and 172 substantially correspond in shape to the openings 160 and 162, respectively, and extend only partially through the sheet 139. Next, both sides of the sheet 139, including the surfaces surrounding the openings 170 and 172, are recoated with photoresist material to form second photoresist layers 252 and 253, which, subsequently, are re-exposed to actinic radiation through another set of glass plates (not shown) having opaque areas thereon that are smaller than the opaque areas on the first set of glass plates to form second openings in the second photoresist layers 252 and 253, shown in FIG. 11. The opaque areas of the second set of glass plates may be offset relative the openings 170 and 172 in the sheet 139 to provide the resultant offset of the second openings in the second photoresist layers 252 and 253, also shown in FIG. 11. The sheet 139 is developed to remove the more soluble, shadowed areas of the resist layers, and etched again to form openings 270 and 272, which extend from the previously etched openings 170 and 172, respectively, and form apertures 190, shown in FIG. 12. The multi-step etch, while described as consisting of only two etch steps, may comprise more than two steps, within the scope of the present invention. The advantage of the multi-step method, shown in FIGS. 9–12, is that, by varying the size of the openings and their locations in each etch step, the resultant apertures 190 have the desired tilt and internal configuration necessary to permit the electron beams 28 to pass therethrough without impinging on the portion of the mask sheet 139 bordering the apertures 190. Additionally, the multi-step etch removes the minimum amount of material from the sheet 139, in the direction of the incident electron beams, thereby providing a mask 125 having greater structural strength than conventional masks with circular apertures in the exterior portion of the cone side thereof.

What is claimed is:

1. A method of forming a plurality of apertures in a metal sheet having a central portion and an exterior portion, as well as a cone side and a grade side, comprising the steps of:

applying a coating of a photoresist material to said cone side and said grade side of said metal sheet to form first photoresist layers having a central portion and an exterior portion thereon;

providing a pattern of first openings in the first photoresist layer on said grade side of said sheet, the first openings on said grade side being the same in the exterior portion and in the central portion of the first photoresist layer;

providing a pattern of first openings in the first photoresist layer on the cone side of said sheet, the first openings on said cone side being different in the exterior portion than in the central portion of the first photoresist layer;

etching said metal sheet through the first openings in the first photoresist layers to form openings extending partially into said metal sheet, said openings in said metal sheet substantially corresponding, in shape, to the first openings in said patterns in the first photoresist layers;

applying a second coating of a photoresist material to said cone side and said grade side of said metal sheet to form a second photoresist layer having a central portion and an exterior portion on each side of said metal sheet;

providing a pattern of second openings in the second photoresist layer, at least on the cone side of said metal sheet, the second openings being different in the exterior portion of the second photoresist layer than in the central portion thereof;

etching said metal sheet through the second openings in the second photoresist layer to form a shadow mask having apertures with openings substantially corresponding to the first and second openings in said patterns of the first and second photoresist layers.

2. The method as described in claim 1, further including the step of stripping the first photoresist layers after etching said metal sheet through the first openings in the first photoresist layers.

3. The method as described in claim 1, wherein the first openings in the first photoresist layer and the second openings in the second photoresist layer, on the cone side of said metal sheet in the exterior portion thereof, are offset relative to the first openings in the first photoresist layer and the second openings in the second photoresist layer on the grade side of said metal sheet.

4. The method as described in claim 1, wherein said openings of said apertures in the exterior portions of said metal sheet are radially elongated on the cone side of said metal sheet.

5. A method of forming a plurality of apertures in a metal sheet used as an aperture mask in a CRT, said aperture mask having a central portion and an exterior portion, as well as a cone side spaced from a screen of said CRT and a grade side facing an electron gun of said CRT, said electron gun providing a plurality of electron beams that are incident on said screen, the method comprising the steps of:

applying a coating of a photoresist material to said cone side and said grade side of said metal sheet to form first photoresist layers having a central portion and an exterior portion thereon;

providing a pattern of first openings in the first photoresist layer on said grade side of said metal sheet, the first openings on said grade side being the same in the exterior portion and in the central portion of the first photoresist layer;

providing a pattern of first openings in the first photoresist layer on the cone side of said metal sheet, the first openings in the exterior portion on the cone side of the first photoresist layer being offset relative to the corresponding first openings in the first photoresist layer on the grade side of said metal sheet;

etching said metal sheet through the first openings in the first photoresist layers to form openings extending partially into said metal sheet, said openings in said metal sheet substantially corresponding, in shape, to said pattern of first openings in the first photoresist layers;

stripping said first photoresist layers from metal sheet;

applying a second coating of a photoresist material to said cone side and said grade side of said metal sheet to form second photoresist layers having a central portion and an exterior portion on each side of said metal sheet;

providing a pattern of second openings in the second photoresist layers, the second openings in the exterior portion of the cone side of the second photoresist layer being offset relative to the corresponding second openings in the second photoresist layer on the grade side of said metal sheet, the second openings in the exterior portion of the second photoresist layers being smaller than the first openings in the first photoresist layers;

etching said metal sheet through the second openings in the second photoresist layers to form said aperture mask having apertures with openings on the cone side that are elongated in the direction of the incident electron beams and offset relative to the corresponding openings on the grade side of said aperture mask.

* * * * *